United States Patent [19]

Tipton

[11] 4,290,405

[45] Sep. 22, 1981

[54] CARBURETOR WITH SONIC FUEL ATOMIZER

[75] Inventor: Larry J. Tipton, Florissant, Mo.

[73] Assignee: ACF Industries, Inc., New York, N.Y.

[21] Appl. No.: 53,935

[22] Filed: Jul. 2, 1979

[51] Int. Cl.[3] ..... F02M 29/00

[52] U.S. Cl. ..... 123/590; 123/585; 261/44 D

[58] Field of Search ..... 123/124 A, 141; 261/DIG. 39, DIG. 56, 64 A, 44 D, 590, 585, 586; 48/180 R

[56] References Cited

U.S. PATENT DOCUMENTS

| | | | |
|---|---|---|---|
| 1,726,864 | 9/1929 | Smith | 123/124 A |
| 1,818,928 | 8/1931 | Kreher | 261/DIG. 39 |
| 2,595,720 | 5/1952 | Snyder | 261/64 R |
| 2,657,913 | 11/1953 | Raymor | 261/64 R |
| 3,151,190 | 9/1964 | Kapitula | 261/64 R |

FOREIGN PATENT DOCUMENTS

| | | | |
|---|---|---|---|
| 2756704 | 7/1978 | Fed. Rep. of Germany | 123/124 A |
| 44-471140 | 9/1969 | Japan | 261/DIG. 56 |
| 982461 | 2/1965 | United Kingdom | 123/141 |

*Primary Examiner*—Ronald H. Lazarus
*Attorney, Agent, or Firm*—J. Joseph Muller

[57] ABSTRACT

A carburetor for an internal combustion engine has a conduit through which air is drawn into the engine, a source of fuel, and means for delivering fuel from the source to the conduit for mixing with air to form an air-fuel mixture combusted in the engine. An improvement comprises a throttle valve positioned at the inlet to the conduit and movable between a closed and an open position to control the quantity of air drawn into the engine.

An outlet is defined for the fuel to be delivered to the conduit, fuel discharged through the outlet being atomized by the air flowing past the outlet.

The air flowing past the fuel outlet flows therepast at substantially sonic velocities thereby to improve fuel atomization and enhance mixing of the air and fuel.

8 Claims, 1 Drawing Figure

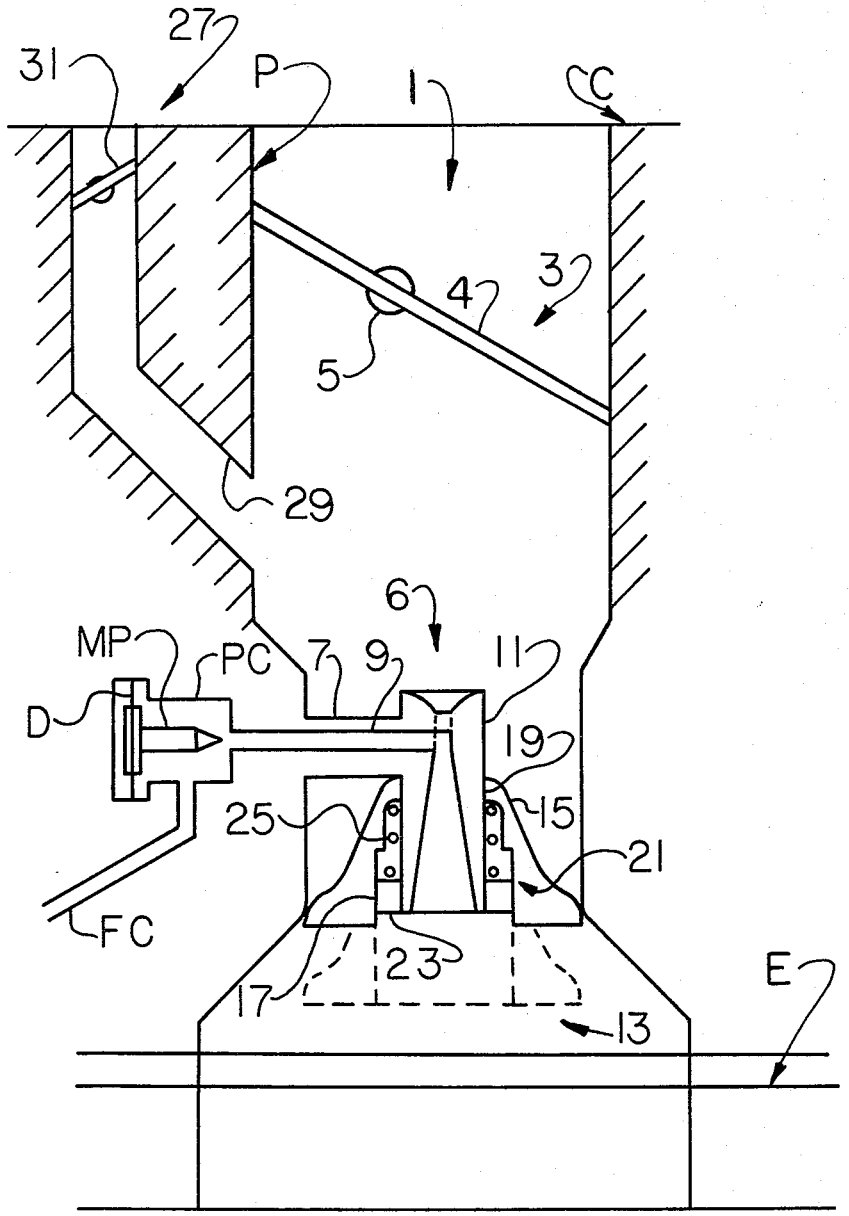
27
31
P
1
C
3
4
5
29
6
MP
PC
7
9
11
D
19
25
15
21
FC
23
17
13
E

CARBURETOR WITH SONIC FUEL ATOMIZER

BACKGROUND OF THE INVENTION

This invention relates to carburetors and, more specifically, to carburetors in which air introduced into the carburetor reaches substantially sonic flow velocities to improve atomization.

With the advent of electronically controlled carburetors, or as they are more commonly referred to, electronic carburetors, closer control is possible over the air-fuel mixture which is supplied to an internal combustion engine so as to both improve fuel economy and reduce exhaust emissions. Even though electronic carburetors have better control over the quantities of fuel and air to be mixed, problems of mixing and distribution still remain. As a result, it is still possible to further improve fuel economy and engine emissions by enhancing the degree of fuel atomization and distribution of the resultant air-fuel mixture to the cylinders of the engine on which the carburetor is installed.

SUMMARY OF THE INVENTION

Among the several objects of the present invention may be noted the provision of an improvement in an electronic carburetor by which substantially sonic air flow is achieved so to enhance mixing of air and fuel in the carburetor; the provision of such an improvement in which the air capacity of the carburetor can be varied for different engine applications; and the provision of such a carburetor improvement by which vortex shedding is achieved to improve mixing of air and fuel in the carburetor.

Briefly, a carburetor for an internal combustion engine has a conduit through which air is drawn into the engine, a source of fuel, and means for delivering fuel from the source to the conduit for mixing with air to form an air-fuel mixture combusted in the engine. An improvement comprises a throttle valve positioned at the inlet to the conduit and movable between a closed and an open position to control the quantity of air drawn into the engine. Means define an outlet for the fuel delivered to the conduit, fuel discharged through the outlet being atomized by the air flowing past the outlet. The air flowing past the fuel outlet is caused to flow therepast at substantially sonic velocities thereby to improve fuel atomization and enhance mixing of the air and fuel. Other objects and features will be in part apparent and in part pointed out hereinafter.

BRIEF DESCRIPTION OF THE DRAWINGS

The single FIGURE of the drawings is a sectional view of a carburetor illustrating the improvement of the present invention by which substantially sonic air flow through the carburetor is achieved, thus to enhance mixing the fuel and air.

DESCRIPTION OF A PREFERRED EMBODIMENT

Referring to the drawing, a carburetor C for an internal combustion engine E has a conduit P through which air is drawn into the engine. Fuel from a source (not shown) is delivered from the source to the conduit for mixing with air to form an air-fuel mixture combusted in the engine. One means of delivering fuel is shown in U.S. Pat. No. 4,141,328, issued to Larry J. Tipton and Steven D. Bryant, Feb. 27, 1979. Pressurized fuel is delivered via a fuel circuit FC to a pumping chamber PC. A metering pin MP has a tapered end which seats in an outlet from the pumping chamber. The other end of pin MP is secured to a diaphragm D which extends across the chamber. The position of the metering pin is a function of the pressure created in chamber PC by the fuel pumped into the chamber through fuel circuit FC. As fuel pressure increases, the diaphragm is moved to left, as seen in the drawing, thus for more fuel to flow out of the pumping chamber.

An improvement to the above-described carburetor is indicated generally 1 and includes a throttle valve 3 positioned at the inlet to conduit P and movable between a closed and open position to control the quantity of air drawn into engine E. The throttle valve comprises a disc 4 mounted on a rotary shaft 5, the rotation of the shaft being controlled in any conventional manner. A means 6 defines an outlet for the fuel to be delivered to the conduit. Means 6 includes a strut 7 projecting outwardly into conduit P. Strut 7 has a central longitudinally extending bore 9 extending from the outlet of pumping chamber PC to a cylindric venturi section 11 which extends from the outer end of strut 7 perpendicular to the strut and parallel to the flow path of air through conduit P.

A means indicated generally 13 causes the air flowing past the fuel outlet to flow therepast at substantially sonic velocities, thus to improve fuel atomization and enhance mixing of the air and fuel. Means 13 comprises a skirt 15 movable along the outside of the venturi section in response to an increasing demand for air by engine E. The movement of the skirt maintains the substantially sonic air velocity at the fuel outlet throughout the range of throttle valve open positions, thus to enhance fuel atomization for a wide range of engine operating conditions. As shown in the drawing, skirt 15 flares outwardly from its upper end to its lower end. Further, the lower end of conduit P slopes outwardly and skirt 15 extends into this lower, larger diameter portion of the conduit. The diameter of the lower portion of skirt 15 is greater than the diameter of the upper end of conduit P. An inwardly extending cavity 17 is formed in the lower face of skirt 15, the cavity extending upwardly to a point relatively near the upper end of the skirt. The upper end of the skirt has a central bore 19, the diameter of which corresponds to the diameter of venturi section 11. Thus, the skirt is mounted over the outside of the venturi section and may move up and down along the section.

A means generally indicated 21 biases skirt 15 upwardly and the lower portion of the skirt may seat against the lower end of the upper portion of conduit P. Means 21 includes a ring 23 which is press fit against the lower end of venturi section 11. A spring 25 seats against the upper surface of ring 23 and bears against the upper end of cavity 17. The location on the venturi section about which ring 23 is pressed is variable, and this permits the air capacity of carburetor C to be varied depending upon the type of engine applicaton with which carburetor C is to be used.

In operation, throttle valve 3 is opened and air is drawn down into conduit P. Skirt 15 is movable as a function of engine air demand and the flow geometry created by the skirt causes the air flowing through the conduit to approach sonic velocities. As a result, improved atomization of the fuel delivered to the conduit and the air is produced. In addition, a swirling or vortex shedding effect is produced beneath the skirt and this further enhances the mixing of fuel and air. This improved mixing of fuel and air is produced throughout the range of throttle positions.

A means 27 admits auxiliary air into conduit P when throttle valve 3 is substantially closed, thus for engine E to operate at fast idle. The auxiliary air means includes an air passage 29 formed in the body of carburetor C and having its outlet at a point below throttle valve 3 and above venturi section 11. A thermostatically controlled valve 31 is positioned at the inlet to passage 29 and valve 31 is responsive to engine temperature to control engine idle. Thus, when the engine is cold, valve 31 is substantially open and sufficient air is drawn into the carburetor to produce an air-fuel mixture which allows the engine to run at an appropriate fast idle speed. As the engine heats up, valve 31 is continuously closed. When the engine reaches its normal operating temperature, valve 31 is substantially closed. As a result, the appropriate amounts of air are drawn into the engine at idle so the engine will perform properly during fast idle. It should be noted that valve 31 may electrically, rather than thermostatically, be controlled to obtain the same result.

In view of the above, it will be seen that the several objects of the invention are achieved and other advantageous results attained.

As various changes could be made in the above constructions without departing from the scope of the invention, it is intended that all matter contained in the above description or shown in the accompanying drawing shall be interpreted as illustrative and not in a limiting sense.

What is claimed is:

1. In a carburetor for an internal combustion engine, the carburetor having a conduit through which air is drwn into the engine and a source of fuel, the improvement comprising:

means for delivering fuel from the source to the conduit for mixing with air to form an air-fuel mixture combusted in the engine, the fuel delivering means including a chamber to which pressurized fuel is delivered, the chamber having an outlet to the conduit, and a tapered fuel metering pin seating in the outlet, the position of the pin in the outlet being a function of the pressure created in the chamber by fuel delivered thereto and controlling the quantity of fuel delivered to the conduit;

a throttle valve positioned at the inlet to the conduit and movable between a closed and an open position to control the quantity of air drawn into the engine;

means defining an outlet for the fuel to be delivered to the conduit, fuel discharged through the outlet being atomized by the air flowing past the outlet; and means for causing the air flowing past the fuel outlet to flow therepast at substantially sonic velocities thereby to improve fuel atomization and enhance mixing of the air and fuel.

2. The improvement as set forth in claim 1 wherein the outlet defining means includes a strut extending outwardly into the conduit and a cylindric venturi section extending from the outer end of the strut perpendicular to the strut and parallel to the flow path of air through the conduit.

3. The improvement as set forth in claim 2 wherein the sonic flow causing means comprises a skirt movable along the outside of the venturi section in response to an increasing demand for air by the engine, the movement of the skirt maintaining a substantially sonic air velocity at the fuel outlet throughout the range of throttle valve open positions thereby to enhance fuel atomization.

4. The improvement as set forth in claim 3 wherein the lower end of the conduit slopes outwardly and the skirt extends into this lower end of the conduit, the diameter of the lower portion of the skirt being greater than the diameter of the upper end of the conduit and the sonic flow causing means further includes means biasing the skirt upwardly to seat the skirt against the lower end of the upper portion of the conduit.

5. The improvement as set forth in claim 4 wherein the skirt has a central bore for installing the skirt over the venturi section and the bias means includes a ring fitted about the lower end of the venturi section and a spring seating against the ring, the location on the venturi section about which the ring is fitted being variable thus to vary the air capacity of the carburetor.

6. The improvement as set forth in claim 5 further including means for admitting auxiliary air into the conduit when the throttle valve is substantially closed thereby to operate the engine at fast idle.

7. The improvement as set forth in claim 6 wherein the auxiliary air means includes an air passage having an outlet into the conduit below the throttle valve and a thermostatically controlled valve at its inlet, the thermostatically controlled valve being responsive to engine temperature to control engine idle.

8. In a carburetor for an internal combustion engine, the carburetor having a conduit through which air is drawn into the engine and a source of fuel, the improvement comprising:

means for delivering fuel from the source to the conduit for mixing with air to form an air-fuel mixture combusted in the engine, the fuel delivering means including a chamber to which pressurized fuel is delivered, the chamber having an outlet to the conduit, a tapered fuel metering pin seating in the outlet and a diaphragm to which the metering pin is attached extending across the chamber, the diaphragm being responsive to the pressure on the fuel delivered to the chamber to move the metering pin in the outlet and thereby control the flow of fuel to the conduit;

a throttle valve positioned at the inlet to the conduit and movable between a closed and an open position to control the quantity of air drawn into the engine;

means defining an outlet for fuel to be delivered to the conduit, the outlet being downstream of the throttle valve and the outlet defining means including a horizontal strut extending outwardly into the conduit and a cylindric venturi section extending from the outer end of the strut perpendicular to the strut and parallel to the flow path of air through the conduit;

a skirt movable along the outside of the venturi section in response to an increasing demand for air by the engine thereby to maintain a substantially sonic air velocity at the fuel outlet, the skirt having a central bore for installing the skirt over the venturi section, the lower end of the conduit sloping outwardly and the skirt extending into this lower end of the conduit and the diameter of the lower end of the skirt being greater than the diamater of the upper end of the conduit;

bias means for biasing the skirt upwardly to seat against the lower end of the upper portion of the conduit, the bias means including a ring fitted about the lower end of the venturi section and a spring seated against the ring, the location on the venturi section about which the ring is fitted being variable thus to vary the air capacity of the carburetor; and means for admitting auxiliary air into the conduit when the throttle valve is substantially closed thereby to operate the engine at fast idle, the auxiliary air means including an air passage having an outlet into the conduit below the throttle valve and a thermostatically controlled valve at the inlet of the passage, the thermostatically controlled valve being responsive to engine temperature to control engine idle.

* * * * *